US005384003A

United States Patent [19]

Mitchell

[11] Patent Number: 5,384,003

[45] Date of Patent: Jan. 24, 1995

[54] DISPENSER FOR TAPES AND SIMILAR WEB MATERIALS INCORPORATING A CUTTING AND DELAYED FEED MECHANISM

[75] Inventor: James G. Mitchell, Oakdale, Minn.

[73] Assignee: Minnesota Mining and Manufacturing Company, St. Paul, Minn.

[21] Appl. No.: 934,556

[22] Filed: Aug. 24, 1992

[51] Int. Cl.[6] ..... B65H 35/07

[52] U.S. Cl. ..... 156/510; 156/574; 156/579; 83/649

[58] Field of Search ..... 83/649, 229, 231, 257; 156/579, 574, 510, 577

[56] References Cited

U.S. PATENT DOCUMENTS

| | | | |
|---|---|---|---|
| 1,977,870 | 10/1934 | Wickliffe | 83/229 |
| 2,718,261 | 9/1955 | Pearson | 83/229 X |
| 3,076,367 | 2/1963 | Leibinger et al. | 83/229 X |
| 3,265,553 | 8/1966 | Kind et al. | 156/579 X |
| 4,089,451 | 5/1978 | Zlaikha | 83/229 X |
| 4,439,257 | 3/1984 | Sato | 156/579 X |
| 5,068,004 | 11/1991 | Moll | 156/494 |

OTHER PUBLICATIONS

3M Brochure, "Scotch S-625 Pad Applicator" 34-70-04-7 (E120.15) R1, 1990.

*Primary Examiner*—Rinaldi I. Rada

*Attorney, Agent, or Firm*—Gary L. Griswold; Walter N. Kirn; Mark W. Binder

[57] ABSTRACT

The mechanism of the dispensing apparatus of the present invention advantageously presents the tape or web material at an application point thereof for easy application of a leading edge of the tape or web material to an object as the dispenser and object are moved relative to one another. After a specific length of tape or web material is applied, the actuation of a single actuation element, by manipulation of a trigger or otherwise, completely severs the previous length of tape that has been applied to the object and then, only after the blade is sufficiently retracted out of the path of the tape or web material, an advancing means drives the tape or web material toward the application point so that it is presented for the next application. The movement of the actuation element from a first position to a second position is transferred to the cutting element for severing the length of tape or web material, and the movement of the actuation element back to its first position is transferred to the cutting element for retraction and, after a time delay, is transferred to the advancing means for advancing the tape or web material to the application point. Thus, after each application and complete cycle of the mechanism of the present invention, the leading edge of the tape is presented for the next application of the tape or web material to the next object.

20 Claims, 3 Drawing Sheets

DISPENSER FOR TAPES AND SIMILAR WEB MATERIALS INCORPORATING A CUTTING AND DELAYED FEED MECHANISM

TECHNICAL FIELD

The present invention relates to a mechanism for cutting and feeding tapes or similar web materials, and more particularly to a dispenser for applying lengths of such tape or web material to an object, wherein the dispenser includes a cutting mechanism and a feeding mechanism for presenting the tape or web material to an application point.

BACKGROUND OF THE INVENTION

The application of web material to objects, and more particularly the application of adhesive tapes to objects, by automatic devices, semi automatic devices, and manual devices is well known. Moreover, many dispensing apparatuses have been designed which are either hand held and portable or are fixed relative to a product line. In either case, such devices typically include mechanisms for cutting and applying the tape or similar web material to the object.

In order to present the tape or web material to a point that facilitates the application of the tape or web material to an object, it is also known to provide feeding mechanisms to dispensing devices which drive the tape or web material along its path through the dispenser to an application point. This is typically done after the previous length of tape or web material is applied to a preceding object so that the tape or web material is available for application to a subsequent object.

A problem associated with the feeding of such tapes or web material is that the feeding should not occur until after the cutting mechanism has cleanly severed the previous length of tape and has gotten out of the way of the leading edge of the supply of tape. If the feeding mechanism drives the tape forward before the cutting mechanism has cleared the path of the tape, the leading edge of the tape may strike the cutting mechanism and the device could jam. Thus, typically the cutting mechanism and the feeding mechanism are controlled separate from one another and are each associated with some control system which permits the advance of the leading edge of the tape only after the cutting mechanism has cleared the path that the tape will follow.

A specific example of a tape applicator including a cutting mechanism and a feeding mechanism wherein the feeding is delayed until after the cutting mechanism clears the tape path, has been used in the Scotch TM S-625 Pad Applicator available from Minnesota Mining and Manufacturing Company of St. Paul, Minn. Specifically, the cutting mechanism which also forms a part of the applying pad mechanism for applying the cut length of tape to an object is controlled by an actuator device comprising an air cylinder. A separate feed mechanism comprising an electric motor and a feed wheel are also provided for advancing the leading edge of the tape only after the cutting mechanism and the applying pad are retracted sufficiently from the path of tape advance. In order to time the mechanisms together, an electric circuit is utilized for driving the electric motor and thus the feed wheel only after a limit switch is actuated by the cutting mechanism when it is sufficiently retracted. In other words, separate cutting and feeding mechanisms are provided which relate to one another via a control system comprising an electrical circuit and limit switch. Although such devices function satisfactorily, they are fairly complex and expensive requiring the combination of drive mechanisms, sensing devices and actuators.

The problem of feeding tape or web material in conjunction with a cutting mechanism is further exasperated when relatively thick tapes or web material are to be dispensed. When a thick tape or web material is dispensed, the cutting mechanism needs a relatively long stroke in order to sever the entire thickness of the tape or web material and the feeding mechanism must be delayed until the cutting mechanism is entirely clear from the thickness of the tape or web material. An example of a thick tape to which the present invention is particularly applicable is a foam tape. Foam tapes typically comprise a strip of foam material having a thickness of at least 0.005 inch and include a layer of adhesive on one side of the foam material. Such foam tapes may also comprise an additional layer of adhesive on the other side thereof and may yet be covered with a cover strip.

One specific tape dispenser specifically directed to the dispensing and application of foam tapes is disclosed is U.S. Pat. No. 5,068,004, granted Nov. 26, 1991 to Moll, which is commonly owned by the assignee of the present invention. The Moll device includes a specific cutting blade for severing tape lengths, but does not include a feeding mechanism for advancing the tape to an application point thereof. Instead, after a length of tape is applied to an object by moving the device along the object, a trigger is squeezed and the width of the tape is only partially cut. Thereafter, an additional length of tape is dispensed by moving the dispenser past the object and thus pulling more tape from the supply, and after a sufficient amount is advanced, a brake mechanism is actuated by the trigger to stop dispensing of the tape. Then, the operator pulls against the applied tape with the brake applied to tear the unsevered portion at the tape cut. The problem with this type of dispenser is that the method of application requires specific operator steps including the pulling of the trigger mechanism twice for each single length of tape dispensed.

Clearly, there is a need for a tape dispenser which can facilitate all tapes and web materials including thick tapes and web materials which is less complex than the control systems associated with the prior art and which can be more easily manipulated by an operator to control both cutting and feeding of the tape without jamming the dispenser.

SUMMARY OF THE PRESENT INVENTION

The present invention overcomes the shortcomings and disadvantages associated with the prior art dispensers discussed above in that an apparatus for dispensing lengths of web material is provided including an actuating element which when manipulated by an operator controls both cutting of the web material and thereafter advancing the web material to the application point. Moreover, the mechanism for cutting and advancing the web material is relatively simple so that the mechanism can be easily provided on a hand held dispenser whereby a single manipulation of a trigger cuts and advances the web material without jamming.

The mechanism of the dispensing apparatus of the present invention advantageously presents the tape or web material at an application point thereof for easy application of a leading edge of the tape or web material to an object as the dispenser and object are moved relative to one another. After a specific length of tape or web material is applied, the actuation of a single actuation element, by manipulation of a trigger or otherwise, completely severs the previous length of tape that has been applied to the object and then, only after the blade is sufficiently retracted out of the path of the tape or web material, an advancing means drives the tape or web material toward the application point so that it is presented for the next application. The movement of the actuation element from a first position to a second position is transferred to the cutting element for severing the length of tape or web material, and the movement of the actuation element back to its first position is transferred to the cutting element for retraction and, after a time delay, is transferred to the advancing means for advancing the tape or web material to the application point. Thus, after each application and complete cycle of the mechanism of the present invention, the leading edge of the tape is presented for the next application of the tape or web material to the next object.

The aforementioned advantages are achieved in accordance with the present invention by an apparatus for dispensing lengths of web material comprising a support frame, a cutting element movably disposed on the support frame, and an advancing means for advancing the web material toward an application point of the apparatus. The cutting element is moveable along a path between a first and second position on the support frame. A guide means is provided for guiding the web material along the dispensing apparatus to the application point and for guiding the web material to pass through the path between the first and second positions of the cutting element so that when the cutting element is moved from the first position to the second position, the cutting element cuts the web material. The cutting element and the advancing means are both controlled by an actuating means or element operatively connected with the cutting element and the advancing means so that movement of the element from a first position to a second position is transferred to the cutting element to move the cutting element from its first to its second position, and movement of the actuating element back to its first position from its second position is transferred to the cutting element to move the cutting element back its first position, and after a time delay is transferred to the advancing means to advance the web material toward the application point. The actuating element can be operably connected with both the cutting element and the advancing means in a variety of ways so long as movement thereof is transferred to the cutting element and the advancing means as above. Preferably, the actuating element is connected with the cutting element and the advancing means by way of a pivoted link supported by the support frame. Between the pivoted link and the advancing means, a delay means is preferably provided so that during the movement of the actuating element from its second position back to its first position, the advancing means is actuated only after a delay period during which time the cutting element moves clear of the path for the tape to be advanced. The advancing means also preferably comprises a feed element and a one-way clutch so that movement in only one direction of the actuating element is transferred to the drive element for engaging and driving the web material toward the application point. Furthermore, the actuating element can be driven by a trigger mechanism in accordance with a hand held version of a dispenser in accordance with the preferred embodiment, or may be driven between its first and second position and back by any other automatic, semiautomatic or other manual system.

BRIEF DESCRIPTION OF THE DRAWINGS

The present invention will be further described below with reference to the accompanying drawings, wherein a preferred embodiment in accordance with the present invention is illustrated and described, in which.

DETAILED DESCRIPTION OF THE PREFERRED EMBODIMENT

Figure 1:
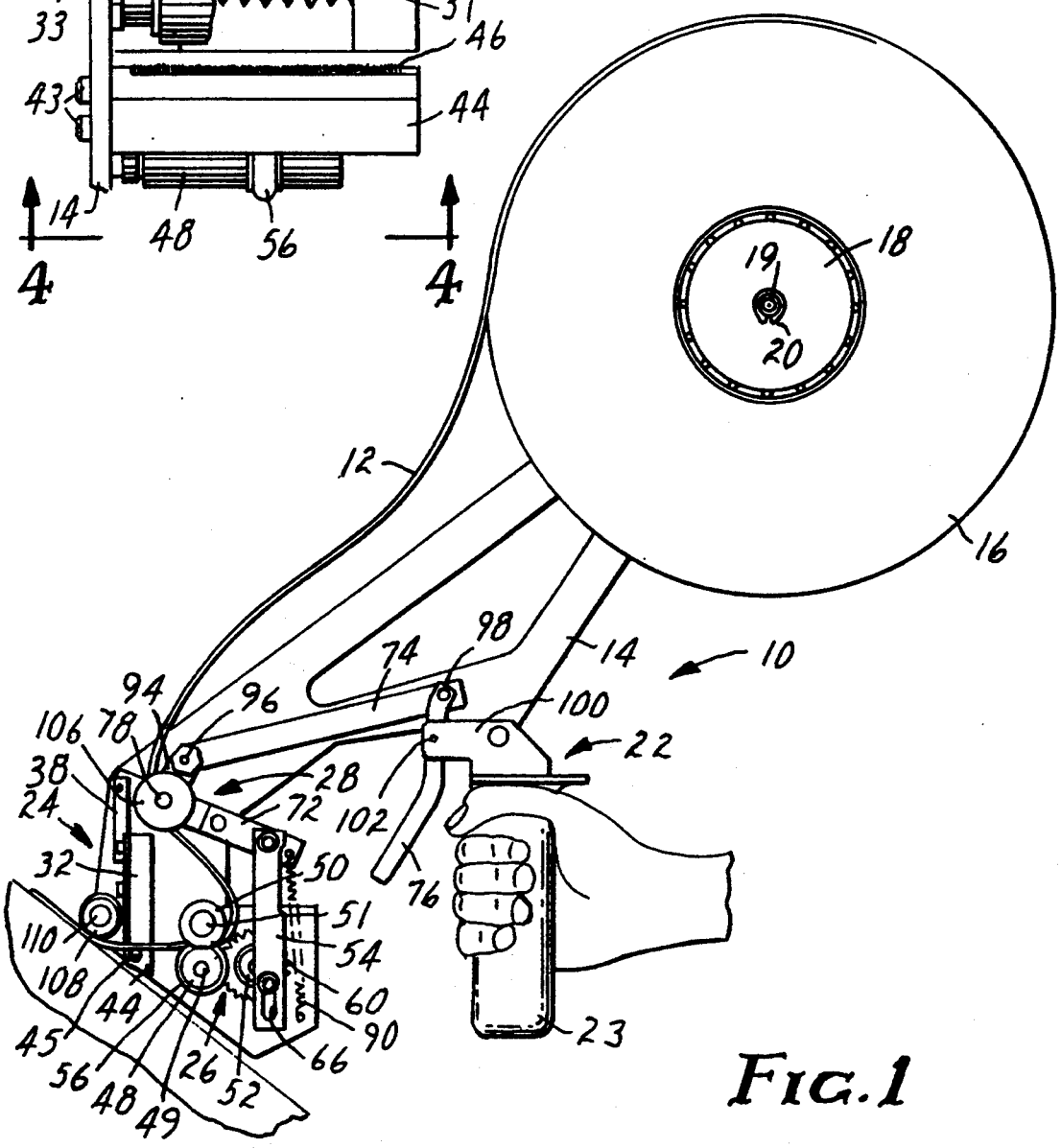
FIG. 1 is a side view of a hand held dispensing apparatus in accordance with the present invention including a supply of web material as it is guided through the dispensing apparatus and applied against an object.

Referring now to the Figures, wherein like components are labeled with like numerals throughout the several Figures, and initially to FIG. 1, a dispensing apparatus 10 is illustrated which comprises a hand held device for dispensing lengths of web material comprising tape 12. As used throughout this application, the term tape is meant to include any web material that is intended to be applied in lengths which are cut from a supply roll or the like, and is not intended to be limited to adhesive tapes, although such tapes are definitely contemplated.

The dispensing apparatus 10 comprises a support frame 14 to which a supply roll 16 of tape 12 is rotatably mounted by way of a hub 18. The hub 18 is conventionally mounted on the support frame 14 with a pivot pin 19 and is held in place by a snap ring 20. The hub 18 is preferably freely rotatably on the pivot pin 19, although any other conventional means for mounting the supply roll 16 to the support frame 14 are contemplated. Also fixed with the support frame 14 is a handle assembly 22. The handle assembly 22 is preferably non-movably fixed with the support frame 14 and includes a gripping portion 23 for grasping by an operator of the subject dispensing apparatus 10.

The dispensing apparatus 10 further basically comprises a cutting means 24, an advancing means 26 and an actuating means 28. Each of the cutting means 24, advancing means 26 and actuating means 28 are operably disposed on and supported by the support frame 14.

Figure 2:
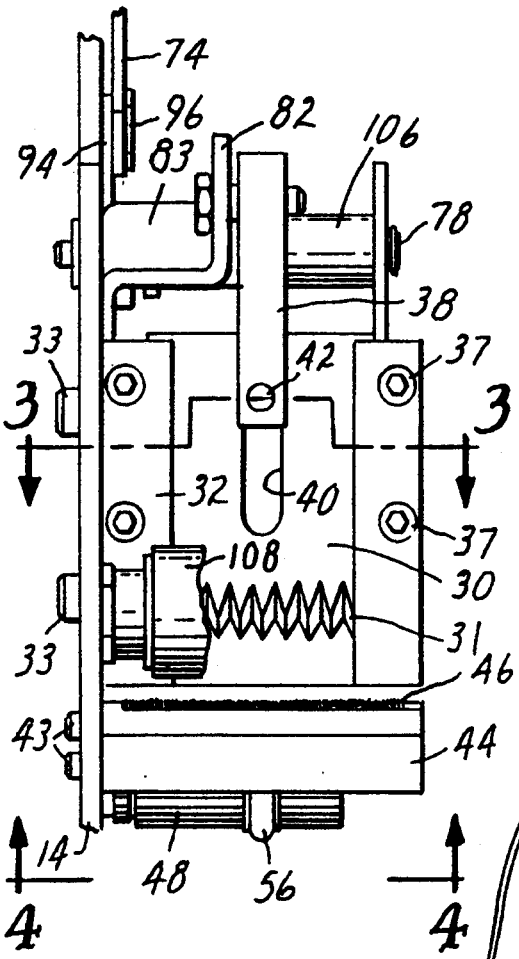
FIG. 2 is a partial front view of the dispensing apparatus of the present invention.
Figure 3:
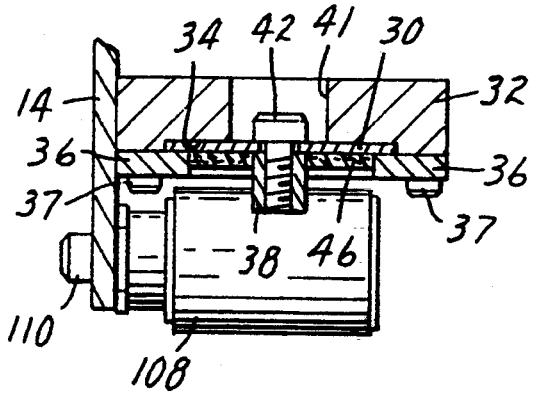
FIG. 3 is a partial cross-sectional view taken along line 3—3 in FIG. 2.

More specifically, the cutting means 24, as best shown in FIGS. 2 and 3, comprises a blade 30 preferably including a serrated cutting edge 31. The blade 30 is mounted to the support frame 14 for reciprocal movement between a retracted and an extended position so that as the blade 30 is extended, it will cut the tape 12 into an applied length of tape as will be more fully described below. A blade guide 32 is fixed to the support frame 14 by conventional means such as screws 33 shown in FIG. 2. As shown in FIG. 3, the blade guide 32 includes a recess 34 which is dimensioned to receive the blade 30 therein. Moreover, the blade 30 is guided for reciprocal movement by the recess 34. In order to retain the blade 30 within the recess 34, retainers 36 are fixed to the blade guide 32 so as to overlap the recess 34 and the side edges of the blade 30 when it is positioned within the recess 34. The use of the retainers 36, as conventionally attached to the blade guide 32 such as by screws 37, permits the easy removal and/or replacement of the blade 30 as necessary.

The blade 30 is further fixed with a drive link 38 so as to be moveable therewith. Preferably, the drive link 38 is adjustably mounted to the blade 30 by way of a slot 40 and a screw 42. Thus, the drive link 38 can be fixed to the blade 30 anywhere along the length of slot 40 in the longitudinal direction of the blade 30 for adjusting the retracted and extended positions of the blade 30. The blade guide 32 is further provided with a slot 41 to facilitate the head of the screw 42 as it moves with the blade 30 between its retracted and extended positions. The drive link 38 is connected at its end distal from its connection to the blade 30 to the actuating means 28 as will further be described below.

Mounted directly below the blade 30 and blade guide 32 is an anvil 44 against which the serrated edge 31 of the blade 30 engages when the blade 30 is extended for cutting a length of the tape 12. Preferably, the anvil 44 is also provided with a soft material such as a felt 46 which extends along the anvil 44 so that the entire width of the serrated edge 31 of the blade 30 will engage the felt 46. Preferably, as is also well known, the felt 46 is oiled so as to assist in clean tape cutting. The felt 46 is located within a transverse recess 45 of anvil 44. The anvil 44 is conventionally mounted to the support frame 14 such as by screws 43.

Figure 4:
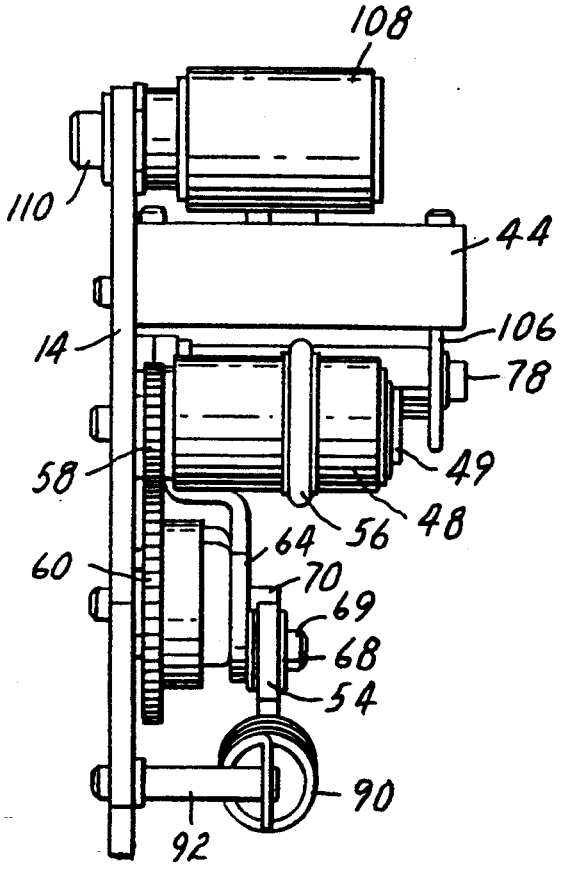
FIG. 4 is a bottom view taken along line 4—4 in FIG. 2 illustrating the advancing means of the present invention.

The advancing means 26, as best seen in FIGS. 1 and 4, comprises a feed roller 48 conventionally mounted to rotate freely on the support frame 14 by a pivot pin 49, a nip roller 50 also conventionally mounted to the support frame 14 to be freely rotatable on a pivot pin 51, a one-way clutch assembly 52 mounted to the support frame 14 and a transfer link 54. The feed roller 48 and the nip roller 50 together define a nip therebetween through which tape 12 is threaded to be engaged by both the feed roller 48 and the nip roller 50 so that rotation of the feed roller 48 advances the tape 12 through the nip. More preferably, the feed roller 48 further includes a rubber ring 56 mounted within a circumferential groove of the surface of the feed roller 48 and located approximately to engage the center line of the tape 12 as it passes through the nip between the feed roller 48 and the nip roller 50. The rubber ring 56 preferably comprises the portion of the feed roller 48 which engages and drives the tape 12 on the feed roller side thereof. The use of the rubber ring 56 is particularly preferable when the tape 12 comprises an adhesive tape and the adhesive side thereof rides against the rubber ring 56.

Also provided to rotate with the feed roller 48 is a driven gear 58. The driven gear 58 meshes with and is driven by a drive gear 60 of the one-way clutch assembly 52. The drive gear 60 is fixedly mounted to rotate with the outer housing of the one-way clutch assembly 52. The one-way clutch assembly 52 preferably comprise a drawn cup roller clutch as is conventionally available. Specifically, a type DC roller clutch available from Torrington Company of Torrington, Conn. is utilized. Model RC-061008-FS having a $\frac{5}{8}$ inch outside diameter and a $\frac{3}{8}$ inch bore is used. Such a one-way clutch assembly basically comprises an external driven housing, a driver shaft and a plurality of rollers between the shaft and the housing which engage against locking ramps in the external housing in one direction. When the shaft is driven in the one direction, the roller bearings lock against the locking ramps and the housing in driven with the shaft. When the shaft is driven in the other direction, the housing remains stationary. In the present invention, as viewed in FIGS. 1, 5 and 6, the one-way clutch assembly 52 permits the drive gear 60 to be driven clockwise while it remains stationary when the one-way clutch 52 is driven counter clockwise.

Figure 5:
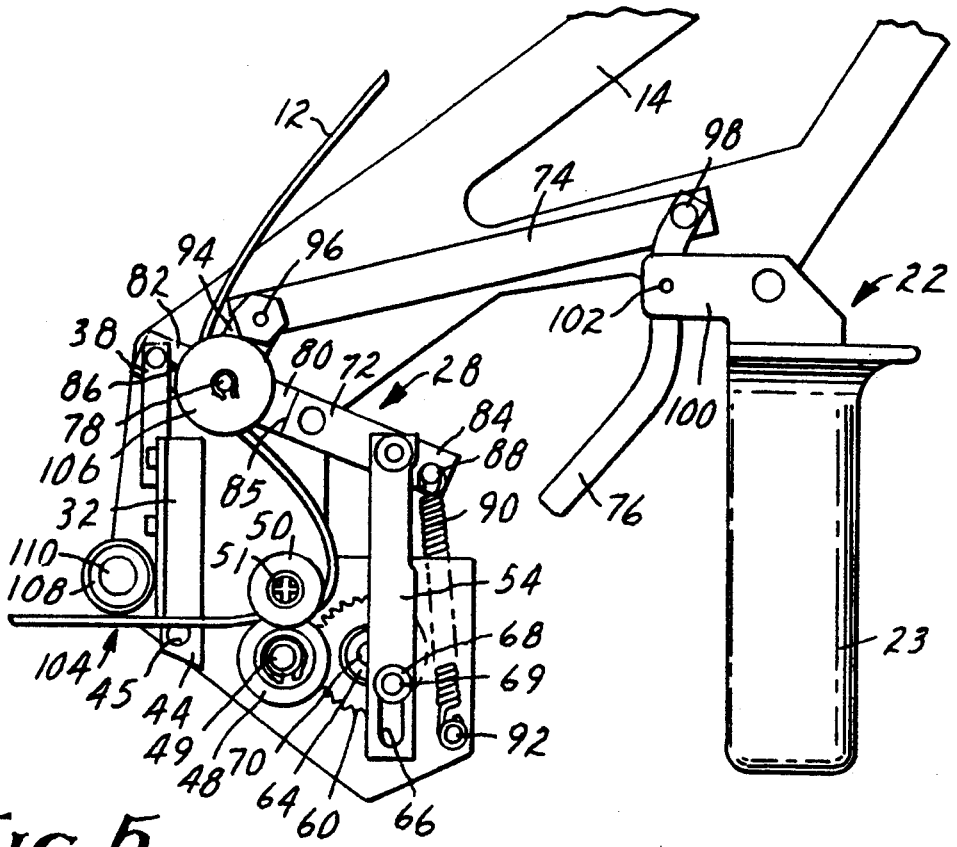
FIG. 5 is a partial side view of the dispensing apparatus of FIG. 1 illustrating the position of the cutting element and advancing means prior to severing an applied length of web material.
Figure 6:
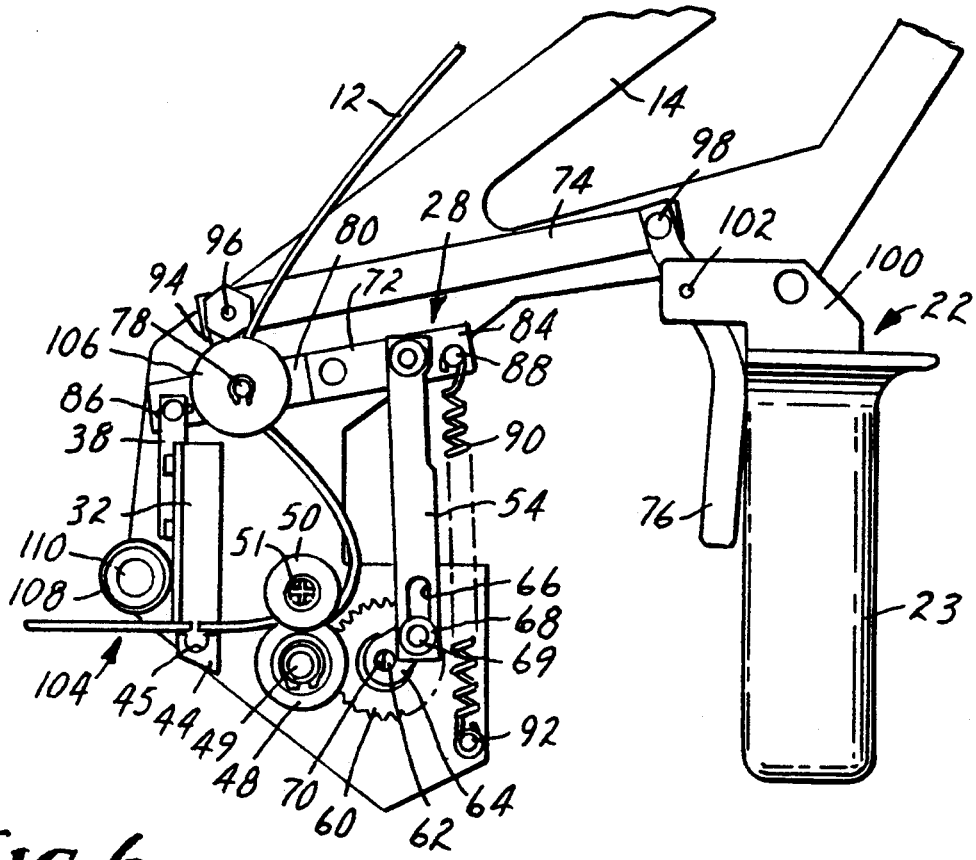
FIG. 6 is a partial side view similar to FIG. 5 but with the actuating element advanced so as to severing a length of web material by the cutting element and the associated position of the advancing means.

As shown in FIGS. 4–6, the shaft 62 of the one-way clutch assembly 52 is fixedly connected to rotate with a lever arm 64. The transfer link 54 is connected with the other end of the lever arm 64 at a slot 66 which comprises a delay means for purposes as will be clearly understood in the operation of the invention described below. A bearing 68 extends through the slot 66 and includes a head portion which is wider than the slot 66. A conventional screw 69 passes through the bearing 68 and is fixed with the lever arm 64 to secure the bearing 68 with the lever arm 64. Thus, movement of the transfer link 54 is transferred to the lever arm 64 in both directions of travel of the transfer link 54, but only after the delay of the slot 66 is taken up. A stop element 70 is also preferably provided extending axially from the shaft 62 to abut against the side edge of the transfer link 54, as shown in FIG. 5, to define the lower limit of travel of the transfer link 54. The other end of the transfer link 54 distal from slot 66 is connected with the actuating means 28 as further described below.

The actuating means 28 in accordance with the preferred embodiment of the present invention comprises a first actuating link 72, a second actuating 74 and a trigger 76 which also comprises an actuating link. Each one of the actuating links 72, 74 or 76 are moveable between first and second positions, wherein the movement of each link from its first to its second position in accordance with the present invention actuates the cutting means 24, and during movement from their second positions back to their first positions causes retraction of the cutting means 24 and advancing of the tape 12 through the advancing means 26 only after the blade 30 of the cutting means 24 clears the path of the advance of the tape 12.

First actuating link 72 is pivotally mounted to rotate on the support frame 14 by a pivot pin 78. The first actuating link 72 is conventionally mounted to rotate on the pivot pin 78 such as by a groove and snap ring. The first actuating link 72 is further defined by a middle portion 80 which rides substantially against the support frame 14, a first end portion 82, see FIG. 2, which connects with the drive link 38 of the cutting means 24 and is spaced from the support frame 14 by a step portion 83, and a second end portion 84 which is pivotally connected with the transfer link 54 of the advancing means 26 and is spaced from the support frame 14 by a step portion 85. The first end portion 82 includes a slot 86 by which the first actuating link 72 is connected to the drive link 38. A conventional bearing and screw assembly such as that described above with regard to the connection of the lever arm 64 to the transfer link 54 is again utilized. The slot 86 is necessary when the first actuating link 72 is pivotally mounted to the support frame 14 since the drive link 38 and blade 30 are limited to linear reciprocating movement. The second end portion 84 of the first actuating link 72 is conventionally pivotally attached to the transfer link 54 such that movement of the first actuating link 72 about pivot pin 78 is transferred directly to the transfer link 54. Also at the second end portion 84, a pin 88 is provided which is attached to a tension spring 90 which biases the first actuating link 72 in a clockwise direction about pivot pin 78. The tension springs 90 is further connected with a pin 92 affixed with the support frame 14 at a point adjacent the advancing means 26.

Also provided as an extension of the first actuating link 72 and to rotate with the first actuating link 72 about the pivot pin 78 is a crank arm 94 which is pivotally connected with the second actuating link 74 at a conventional pivot pin 96. At the other end of the second actuating link 74 distal from the pivot pin 96, the second actuating link 74 is pivotally connected with the trigger 76 by yet another conventional pivot pin 98. The trigger 76 is mounted to the handle assembly 22, which comprises space plates 100 (only one of which is visible in the figures) to pivot about pin 102 which is supported between the space plates 100. The space plates 100, are non-rotatably fixed with the support frame 14.

In order to guide the tape 12 through the dispensing apparatus 10 of the present invention, a guide means is defined through the dispensing apparatus 10 to an application point 104 thereof. The guide means comprises an idler roller 106 mounted to be freely rotatable on the pivot pin 78 of the first actuating link 72, the nip between the nip roller 50 and feed roller 48, and an application roller 108 which is mounted to be freely rotatable about a pivot pin 110 in a conventional manner. The pivot pin 110 is fixed with the support frame 14 adjacent to the application point 104. The idler roller 106, nip roller 50 and application roller 108 together define the path of the tape 12 through the dispenser apparatus 10, that path crossing the path of the blade 30 between its retracted and extended position. Specifically, the tape 12 extends between the lower end of the blade guide 32 and the anvil 44.

The operation of the dispensing apparatus 10 in accordance with the present invention will now be described with reference to FIGS. 5 and 6. Initially, the tape 12 is threaded over the idler roller 106, through the nip between the nip roller 50 and feed roller 48, between the blade guide 32 and the anvil 44, and at least to the application point 104 on the application roller 108. For application of the tape 12 to an object, the tape 12 at the application roller is pressed against the object by the application roller 108 while the dispensing apparatus 10 is maintained as shown in FIG. 5 with the trigger released and the cutting means 24, advancing means 26 and actuating means 28 at rest under the influence of tension spring 90. Specifically, the blade 30 is fully retracted by drive link 38 and the first actuating link 72.

Tape 12 is then dispensed from the supply roll 16 by relatively moving the dispensing apparatus 10 with respect to the object to which the tape 12 is applied. Such movement pulls tape 12 from the supply roll 16 and over the guide path described above. After application of a length of tape 12, when it is desired by the operator to cut the tape 12, the trigger 76 is squeezed toward the gripping portion 23 of handle assembly 22. The movement of the trigger 76 from its first position to a second position near gripping portion 23 is transferred to second actuating link 74 which moves from its first position to a second position. At the same time, first actuating link 72 is pivoted about pivot pin 78 from its first position shown in FIG. 5 to an angularly displaced position shown in FIG. 6 counter-clockwise from its first position. Pivotal movement of first link 72 drives drive link 38 via slot 86 along the blade guide 32, which in turn drives blade 30 along recess 34 such that the serrated cutting edge 31 is advanced to fully engage the felt 46 of the anvil 44. Thus, the tape 12 is cut and the application length of tape 12 is defined.

At the same time, transfer link 54 is moved upwardly, that is toward second actuating link 74. As the transfer link 54 is moved upwardly for the longitudinal distance of the slot 66, the lever arm 64 remains stationary. Then, when the lower edge of slot 66 engages the lower edge of bearing 68, the lever arm 64 is rotated counter clockwise with shaft 62 of the one-way clutch assembly 52. The one-way clutch 52 is arranged such that this counter-clockwise movement of the shaft 62 does not drive the drive gear 60. Thus, feed roller 48 remains stationary during the cutting operation.

Thereafter, the trigger 76 is allowed to return to its first position under the influence of tension spring 90. During this return movement, second actuating link 74 moves toward its first position, first actuating link 72 pivots back toward its first position, drive link 38 and blade 30 are retracted, and transfer link 45 moves downwardly to return to its initial position. The lever arm 62, which is at rest, is unmoved by the transfer link 54 for the amount of movement of the transfer link 54 equal to the longitudinal length of the slot 66. When the top edge of slot 66 engages the top edge of bearing 68, the lever arm 64 will be driven clockwise with shaft 62 for the remainder of movement of the transfer link 54 downwardly. The remaining amount of movement defines the amount of tape 12 advanced as will be apparent from the description below.

The clockwise movement of shaft 62 causes the one-way clutch assembly 52 to engage and drive the external housing thereof which is fixed with drive gear 60. Thus, the angular movement of the lever arm 64 equals the angular movement of drive gear 60. The drive gear 60 further drives driven gear 58 which is fixedly rotatable with feed roller 48 which in turn engages the underside of tape 12 to advance the tape 12 by an amount determined by the degree of movement of the feed roller 48. More specifically, the advance equals the surface distance of the movement of feed roller 48 and more specifically that of the rubber ring 56 thereof. The amount of advance of the tape 12 is provided such that the leading edge of the tape located between the blade guide 32 and the anvil 44 just after cutting is advanced to the application point 104. When the advance is complete, the transfer link 54 assumes its second position with an edge adjacent stop 70.

The interaction between the slot 66 of the transfer link 54 and bearing 68 of the lever arm 64 comprises a delay means which only advances the tape 12 after the cutting blade 30 is sufficiently retracted out of the path of the advance of the tape 12. More specifically, the blade is preferably retracted within the blade guide 32 before the advancing means 26 is actuated. The longitudinal length of the slot 66 defines the amount of movement of the blade 30 toward it retracted position before the lever arm 64 is rotated and the tape 12 is advanced.

The length of the slot 66 is determined depending on the thickness of the tape 12, and the relative distances between the connection of the drive link 38 and transfer link 54 to the first actuating link 72 from its pivot pin 78.

It is also contemplated that many other mechanisms could be utilized in the present invention for accomplishing the desired result including a delay means. Moreover, whether looking at the first actuating link 72, the second actuating link 74, or the trigger 76, they each have in common the fact that a single actuator link which is moveable between a first and second position can effectively control the cutting and advancing means. Moreover, it is contemplated that the cutting means and advancing means could be similarly connected with an actuating link which is linearally moveable instead of pivotal as in the case of the first actuating link 72 described above. In such case, a link moveable in the same direction of movement as the blade 30 could be connected both with the blade 30 and a transfer link 54, wherein it would be necessary to include a reversing gear between the drive gear 60 and the driven gear 58 since the transfer link 54 would be oppositely moving.

Furthermore, it is understood that any one of the actuating links could be connected with any other type of actuator which could comprise a manual means or a power means, such as using electrical power, hydraulics, pneumatics or the like. The supply roll 16 could also be power driven and controlled as conventionally known depending on the type of web material to be applied in accordance with the present invention.

What is claimed is:

1. A hand-held foam tape applicator for dispensing and applying lengths of foam tape comprising:

a support frame;

a tape source support means provided on said support frame for rotatably supporting a source of foam tape thereon;

a handle connected with said support frame including a gripping portion for holding and manipulating said hand-held foam tape applicator;

a cutting element movably disposed on said support frame and movable along a path between a first position and a second position;

guide means for guiding the foam tape along said dispensing apparatus to an application element operatively connected to said support frame, and for guiding the foam tape to pass through said path between said first and second positions of said cutting element so that when said cutting element is moved from said first position to said second position, said cutting element cuts the foam tape;

advancing means for advancing the foam tape along said guide means toward said application element; and an actuating means comprising a link operatively connected to said cutting element and said advancing means so that movement of said link from a first position to a second position is transferred to said cutting element to move said cutting element from its first position to its second position, and movement of said link from said second position toward its first position is transferred to said cutting element to move said cutting element back to its first position, and after a time delay that is sufficient to allow said cutting element to fully retract from the foam tape, it is transferred to said advancing means to advance the foam tape towards said application element.

2. The apparatus of claim 1, wherein said link of said actuating means comprises a pivotally mounted link, and said first and second positions thereof comprise angularly spaced positions.

3. The apparatus of claim 2, wherein said actuating means further comprises a second link operatively connected with said pivotally mounted link for driving said pivotally mounted link between its first and second positions.

4. The apparatus of claim 3, wherein said actuating means further comprises a trigger mechanism pivotally mounted to said support frame for operation by a user of the apparatus, and said trigger mechanism is connected with said second link for driving the second link between first and second positions.

5. The apparatus of claim 1, wherein said advancing means includes a feed roller rotatably supported on said support frame, a transfer link connected to said link of said actuating means, and a conversion means between said transfer link and said feed roller for converting movement of said transfer link between first and second positions thereof to rotary motion of said feed roller during movement of said link of said actuating means from its second position to its first position after said time delay.

6. The apparatus of claim 5, wherein said conversion means includes a delay means at its connection to said transfer link for providing said time delay.

7. The apparatus of claim 6, wherein said conversion means further comprises a one-way clutch supported on said support frame for driving said feed roller only when the transfer link moves from its second position to its first position after said time delay.

8. The apparatus of claim 7, wherein said delay means comprises a longitudinal slot through said transfer link to which a lever arm is pivotally connected, said lever arm being further connected to a drive shaft of said one-way clutch.

9. The apparatus of claim 8, wherein said one-way clutch includes a drive gear meshed with a driven gear provided to rotate with said feed roller.

10. An apparatus for dispensing lengths of web material comprising:

a support frame;

a cutting element movably disposed on said support frame and movable along a path between a first position and a second position;

guide means for guiding the web material along said dispensing apparatus to an application point thereof, and for guiding the web material to pass through said path between said first and second positions of said cutting element so that when said cutting element is moved from said first position to said second position, said cutting element cuts the web material;

advancing means for advancing the web material along said guide means toward said application point; and an actuation element pivotally supported on said support frame to move about a pivot point between first and second positions and operatively connected with said cutting element on one side of said pivot point and to said advancing means on the other side of said pivot point so that movement of said actuation element from its first position to its second position is transferred to said cutting element to move said cutting element from its first position to its second position, and movement of said actuation element from its second position back to its first position is transferred to said cutting element to move said cutting element from its second position back to its first position, and after a time delay, it is transferred to said advancing means to advance the web material toward said application point.

11. The apparatus of claim 10, wherein said actuation element comprises a pivotally mounted link, and said first and second positions thereof comprise angularly spaced positions.

12. The apparatus of claim 11, wherein a second link is operatively connected with said pivotally mounted link for driving said pivotally mounted link between its first and second positions.

13. The apparatus of claim 12, further comprising a trigger mechanism pivotally mounted to said support frame for operation by a user of the apparatus, and said trigger mechanism is connected with said second link for driving the second link between first and second positions.

14. The apparatus of claim 10, wherein said advancing means includes a feed roller rotatably supported on said support frame, a transfer link connected to said actuation element, and a conversion means between said transfer link and said feed roller for converting movement of said transfer link between first and second positions thereof to rotary motion of said feed roller during movement of said actuation element from its second position to its first position after said time delay.

15. The apparatus of claim 14, wherein said conversion means includes a delay means at its connection to said transfer link for providing said time delay.

16. The apparatus of claim 15, wherein said conversion means further comprises a one-way clutch supported on said support frame for driving said feed roller only when the transfer link moves from its second position to its first position after said time delay.

17. The apparatus of claim 16, wherein said delay means comprises a longitudinal slot through said transfer link to which a lever arm is pivotally connected, said lever arm being further connected to a drive shaft of said one-way clutch.

18. The apparatus of claim 17, wherein said one-way clutch includes a drive gear meshed with a driven gear provided to rotate with said feed roller.

19. An apparatus for dispensing lengths of web material comprising:

a support frame;

a cutting element movably disposed on said support frame and movable along a path between a first position and a second position;

guide means for guiding the web material along said dispensing apparatus to an application point thereof, and for guiding the web material to pass through said path between said first and second positions of said cutting element so that when said cutting element is moved from said first position to said second position, said cutting element cuts the web material;

advancing means for advancing the web material along said guide means toward said application point; and an actuation element supported on said support frame to move between first and second positions and operatively connected with said cutting element and said advancing means so that movement of said actuation element from its first position to its second position is transferred to said cutting element to move said cutting element from its first position to its second position, and movement of said actuation element from its second position back to its first position is transferred to said cutting element to move said cutting element from its second position back to its first position, and after a time delay, it is transferred to said advancing means to advance the web material toward said application point;

wherein said advancing means includes a feed roller rotatably supported on said support frame, a transfer link connected to said actuation element, and a conversion means between said transfer link and said feed roller for converting movement of said transfer link to rotary motion of said feed roller during movement of said actuation element from its second position to its first position after said time delay, said time delay provided by a longitudinal slot through said transfer link which is connected to said conversion means.

20. The apparatus of claim 19, wherein said conversion means comprises a one-way clutch that includes a drive gear meshed with a driven gear provided to rotate with said feed roller.

* * * * *